US010914079B2

(12) United States Patent
Deetz

(10) Patent No.: US 10,914,079 B2
(45) Date of Patent: Feb. 9, 2021

(54) MAGNETIC HOLDING SYSTEM WITH ENHANCED MAGNETIC STRENGTH

(71) Applicant: Deetz Family, LLC, Mendon, MA (US)

(72) Inventor: Dayton J. Deetz, Mendon, MA (US)

(73) Assignee: Deetz Family, LLC, Mendon, MA (US)

( * ) Notice: Subject to any disclaimer, the term of this patent is extended or adjusted under 35 U.S.C. 154(b) by 22 days.

(21) Appl. No.: 16/302,510

(22) PCT Filed: May 16, 2017

(86) PCT No.: PCT/US2017/032914

§ 371 (c)(1),
(2) Date: Nov. 16, 2018

(87) PCT Pub. No.: WO2017/201054

PCT Pub. Date: Nov. 23, 2017

(65) Prior Publication Data

US 2019/0383025 A1 Dec. 19, 2019

Related U.S. Application Data

(60) Provisional application No. 62/337,115, filed on May 16, 2016.

(51) Int. Cl.

| | |
|---|---|
| ***A47G 1/17*** | (2006.01) |
| ***E04F 13/08*** | (2006.01) |
| ***G09F 7/04*** | (2006.01) |
| *A47G 1/06* | (2006.01) |

(52) U.S. Cl.

CPC ..... *E04F 13/0883* (2013.01); *G09F 7/04* (2013.01); *A47G 2001/0672* (2013.01)

(58) Field of Classification Search

CPC ..... E04F 13/0883; G09F 7/04; A47K 1/09; H01F 7/02; F16B 2001/0035; A47G 1/17

USPC ..... 248/206.5, 683, 309.4; 292/251.5; 428/195.1, 692.1, 693.1

See application file for complete search history.

(56) References Cited

U.S. PATENT DOCUMENTS

| | | | | |
|---|---|---|---|---|
| 2,414,653 | A | 1/1947 | Lockholder | |
| 4,058,335 | A * | 11/1977 | Abe | E05C 19/16 292/251.5 |
| 5,205,091 | A | 4/1993 | Brown | |
| 8,747,996 | B2 * | 6/2014 | Deetz | G09F 7/04 40/426 |
| 8,747,998 | B2 * | 6/2014 | Chang | C23C 14/10 428/336 |

(Continued)

*Primary Examiner* — Todd M Epps
(74) *Attorney, Agent, or Firm* — St. Onge Steward Johnston & Reens, LLC

(57) ABSTRACT

A magnetic holding system for securely affixing an object to a wall surface including a first magnetic sheet layer having specific polarity line spacing, a second layer having magnetic receptive properties, and finally an object with a mounting surface designed to abut the second layer, the mounting surface including a magnetic material having specific polarity line spacing that is substantially the same as the specific polarity line spacing of the first layer and a sheet of steel, such that, when the object polarity line spacing is aligned with the first layer polarity line spacing, the object is securely held to the wall.

18 Claims, 7 Drawing Sheets

(56) References Cited

U.S. PATENT DOCUMENTS

2011/0165386 A1* 7/2011 Deetz ..... G09F 23/06
428/195.1

* cited by examiner

MAGNETIC HOLDING SYSTEM WITH ENHANCED MAGNETIC STRENGTH

FIELD OF THE INVENTION

The invention relates to a magnetic wall system, and in particular, to a system including a series of layers that are placed on a wall such that objects may be secured to a wall in a robust fashion purely by magnetic interaction of the object and the wall.

BACKGROUND OF THE INVENTION

Print media products including magnetic properties are often prepared by applying a magnetic receptive coating to one-sided of a commercially extruded film after the extrusion process. These products have experienced good commercial success.

One such system is disclosed in U.S. Pat. No. 8,747,996 (the '996 patent) entitled Magnetic Graphic Wall System. The '996 provided a very good system for hanging printed images and lightweight dimensional objects on a wall, for example, for applications in layering wallpapers with printed images. The success of the system embodied in the '996 patent has led to the issue of seeking to secure other objects to a wall in a robust and secure fashion. While the '996 patent was a large leap forward in technology, the issue of creating a stronger bond between an object and the wall is seen as a particular challenge.

For example, in commercial setting, an image of a basketball player may be adhered to the wall in a store according to the system disclosed in the '996 patent. However, it was found that attaching an object (a three dimensional object) to the wall via a purely magnetic coupling, was met with only very limited success and did not exhibit the required holding power needed to securely maintain heavier objects to the wall.

A challenge faced by current system is therefore, how to provide for objects (such as, three dimensional objects) to be adhered to the wall purely by magnetic means while at the same time, forming a strong enough magnetic coupling between the wall and the object so that the object is securely and reliably adhered to the wall. Likewise, the object needs to be removable from the wall without damaging the wall or the magnetic system. To date, systems developed have been limited in achieving this desired goal.

SUMMARY OF THE INVENTION

What is desired then, is a system and method for securing an object to a wall purely by magnetic interaction while at the same time providing an extremely robust connection.

It is also desired to provide a system and method that provides for strengthening the bonding connection between an object and a wall while simultaneously allowing the object to be removed and relocated and/or reused while not damaging the wall or the magnetic system.

These and other objectives are achieved in one configuration in which a layer of steel is placed on the wall facing side of the object to be attached to the wall, then a sheet of magnet is placed on the surface of the steel. When the object is placed on the wall the magnet is in contact with the wall surface allowing the polarity lines to align while the underlying steel is magnifying the magnetic strength. The positioning of the steel layer functions as an amplifier to dramatically enhance the magnetic bonding strength of the system. This high bonding strength system is based on determination that a sheet of steel, when combined with a layer of magnet sheet having polarity lines that are substantially the same as those of the polarity lines on the wall will enhance the magnetic holding power of the system. This configuration furthermore allows for self-leveling of the object.

A magnetic holding system in accordance with one configuration includes a first layer of magnetic receptive primer coating(s) on a wall surface, a second layer of magnet sheet with a specific polarity line spacing which is positioned onto the layer of the primer painted wall, and a third layer of printed or decorative images having magnetic receptive properties which is positioned on top of the second layer of magnet sheet, and finally an object for providing a holding space is placed on top of the layer of, for example, printed or decorative images. The object is provided with a magnetic mounting surface, incorporating both a sheet magnet and sheet steel which is to be placed against the third layer, and having polarity line spacing in the magnet portion of the magnetic mounting surface being virtually identical with that of the magnet sheet layer on the wall. The magnetic mounting surface of the object will be in direct contact with the top layer, such that, magnetic forces pull and hold the object onto the wall surface, providing a holding space attached to the wall.

In one example, it is conceived that the object comprises a shelf that includes a substantially smooth mounting surface that is to be positioned against a wall surface. The mounting surface of the shelf comprises a sheet of steel (or other magnetically permeable material) and the magnetic sheet material. The magnetic sheet material includes magnetic properties with a specific polarity line spacing. The shelf is designed to be applied to a wall surface that has also been installed with the sheet magnet material. The sheet steel is affixed to the mounting surface of the shelf, or alternatively, the shelf may comprise steel. The sheet of magnet is magnetized on both sides and is simply placed on the surface of the sheet steel. The magnet surface of the shelf is now in direct contact with the layer of decorative wall covering and allows for the alignment of the underlying polarity lines while the steel is amplifying the magnetic properties. The mounting surface is in contact with the wall surface, leaving the space or platform of the object accessible for receiving and displaying an article on the wall (e.g., merchandise may be displayed on the shelf).

For this application, the following terms and definitions shall apply:

The terms "first", "second", "third" and "fourth" are used to distinguish one element, set, data, object or thing from another, and are not used to designate relative position or arrangement in time.

In one configuration a magnetic holding system on a wall is provided comprising: a first layer of magnetic sheet with a specific polarity line spacing, the first layer being overlaid onto the wall surface and a second layer of material having magnetic receptive properties, the second layer being overlaid on the first layer. The holding system further comprises an object having a substantially smooth mounting surface, the mounting surface comprising a magnetic material having specific polarity line spacing that is substantially the same as the specific polarity line spacing of the first layer and a magnetically permeable material. The holding system is provided such that when the polarity line spacing of the magnetic material applied to the mounting surface is oriented with the polarity line spacing of the first layer, the object is securely held against the wall.

In another configuration a method for holding an object to a wall is provided comprising the steps of overlaying a first layer of magnetic sheet with a specific polarity line spacing onto a wall surface, overlaying a second layer of material having magnetic receptive properties onto the first layer and providing an object with a substantially smooth mounting surface and comprising a magnetic material that has a polarity line spacing and a magnetically permeable material. The method further comprises the steps of positioning the mounting surface against the second layer and orienting the object such that the polarity line spacing of the magnetically permeable material of the mounting surface aligns with the polarity line spacing of the first layer such that, when the polarity line spacings are aligned, the object is securely held against the wall.

Other objects of the invention and its particular features and advantages will become more apparent from consideration of the following drawings and accompanying detailed description.

DETAILED DESCRIPTION OF THE INVENTION

Figure 1:
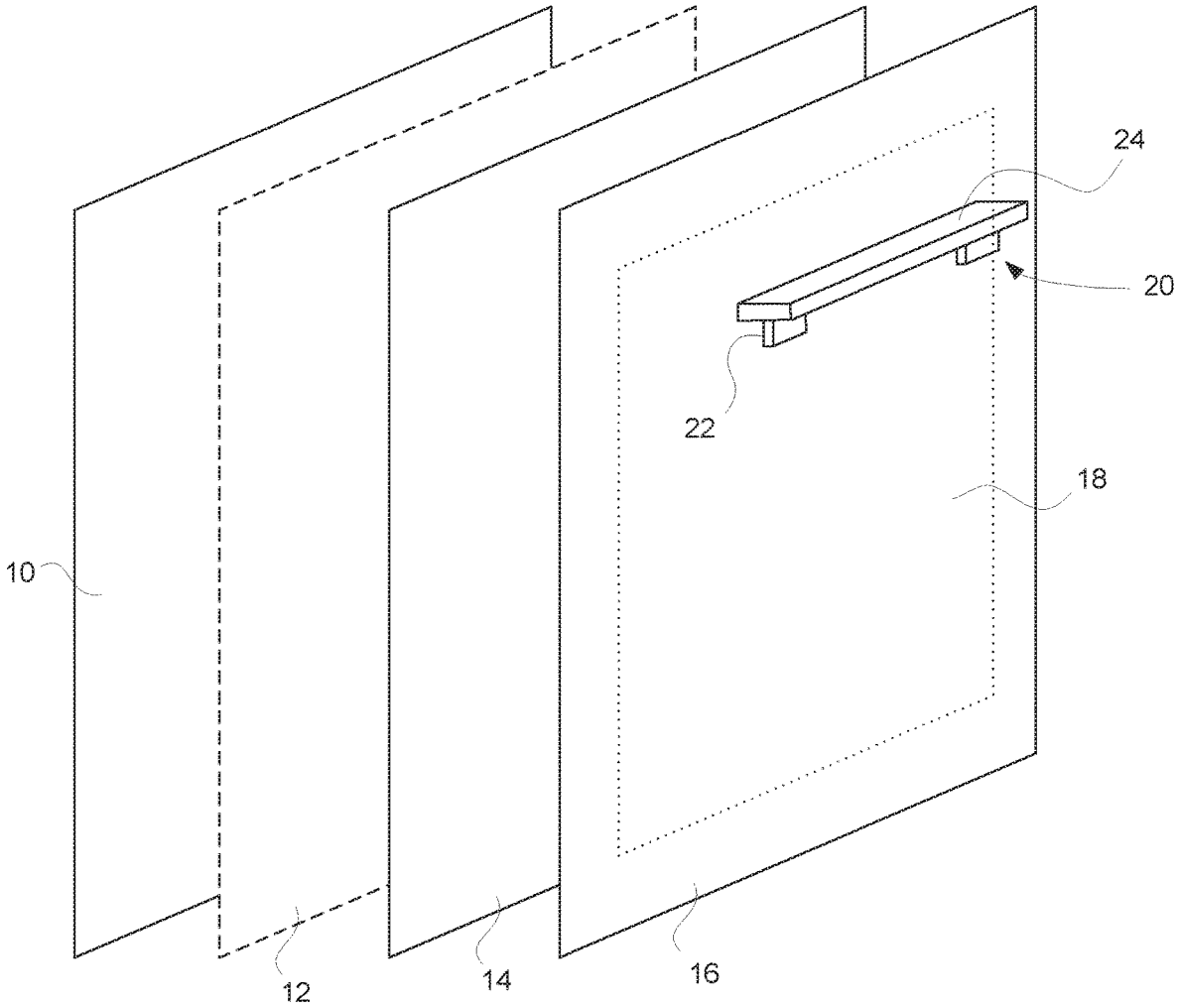
FIG. 1 is an exploded perspective view of a magnetic holding system including three layers that may be affixed to a wall surface along with an object that may be affixed to the surface of the third layer.

Referring now to the drawings, wherein like reference numerals designate corresponding structure throughout the views.

FIG. 1 is an illustration showing an exploded view of various layers according to the invention. A magnetic holding system is provided including at least three elements, two of which are layers (with an optional third layer in some configurations). In one configuration, a third layer 12 comprises a magnetic receptive primer coating(s) painted over a wall surface 10. In another configuration, the third layer 12 is not utilized, which is why it is illustrated in dashed line as an optional feature.

A first layer 14 is a magnetic sheet with a specific polarity line spacing, which is layered onto or overlain onto the primer painted wall. As an example, the first layer 14 could comprise a magnetic sheet comprising a range from 15 to 40 mil and in a preferred embodiment, comprising a 28 mil rubber extruded sheet magnet. Functionally, a magnetic force generated by the magnetic sheet works to hold the first layer to the magnetic receptive primer coating(s), which in turn, functions to hold the first layer 14 to the wall surface 10. In this configuration, the first layer 14 is provided as a double sided sheet of magnetic material. In particular, the first layer 14 is provided as a ferrite-based magnetic system, which unlike stronger rare-earth permanent magnets, the multipole nature of ferrite magnets does not emit a strong magnetic field into its environment. Alternatively, the back side of the first layer 14 could comprise an adhesive backing to secure the first layer 14 to the wall surface.

It is contemplated that a typical color coating (i.e., a white color) may be applied over the magnetic receptive primer coating(s) to provide a natural and/or a colorful look to the wall surface 10. In this manner, the wall surface 10 would look "normal" when it is not layered with the magnet sheet 14. In the event that the third layer is used, such magnetic receptive primer treated wall surface, may also be referred to as an "activated" wall surface.

The second layer 16 of the magnetic holding system is a relatively thin (e.g. 11 mil) sheet material and may (or may not) include a printed or decorative image page. This second layer 16 includes a magnetic receptive material on the back side thereof. In practice, the second layer 16 is positioned over top of the first layer 14 of magnetic sheet material, which will provide for displaying a printed or decorative image 18 on a surface thereof. Preferably, the image completely covers the magnet sheet and creates an artistic image of the wall. The second printed or decorative image layer 16 can be made of paper, plastic, fiber, etc. The magnetic receptive coating on the back of the second printed or decorative image layer 16 is provided to be in direct contact with the first magnetic sheet layer 14. The magnetic forces therebetween pull the second printed or decorative image layer 16 to the wall, forming a smooth, image surface on the wall.

Figure 2:
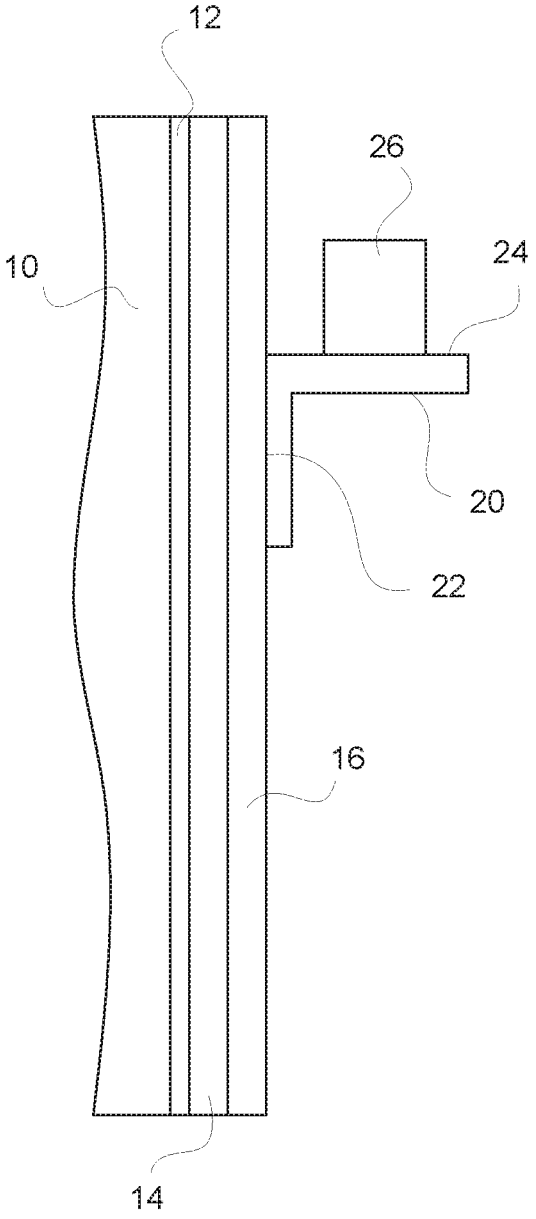
FIG. 2 is a side view of the magnetic holding system including layers affixed to a wall surface along with an object that is affixed to the surface of the third layer according to FIG. 1.

A object 20 is also illustrated in FIGS. 1 and 2, which in this example, comprises a three-dimensional object (e.g., a shelf). On the one hand, the object 20 includes a smooth mounting surface 22 having magnetic properties for pulling and holding the object to the wall surface 10. On the other hand, the object provides a space or platform 24 that may be used to hold an article 26 for display. In one embodiment, the mounting surface 22 of the object 20 is equipped with or made of a sheet of magnetically permeable material, such as steel. In another embodiment, the entire object is made of a magnetically permeable material. In addition to steel, those of skill in the art will understand that different types of metals having magnetic properties or materials that can be imparted with magnetic properties would be suitable for use in the present invention. A sheet of magnetic material is then overlain on the magnetically permeable material comprising the mounting surface 22.

Figure 3:
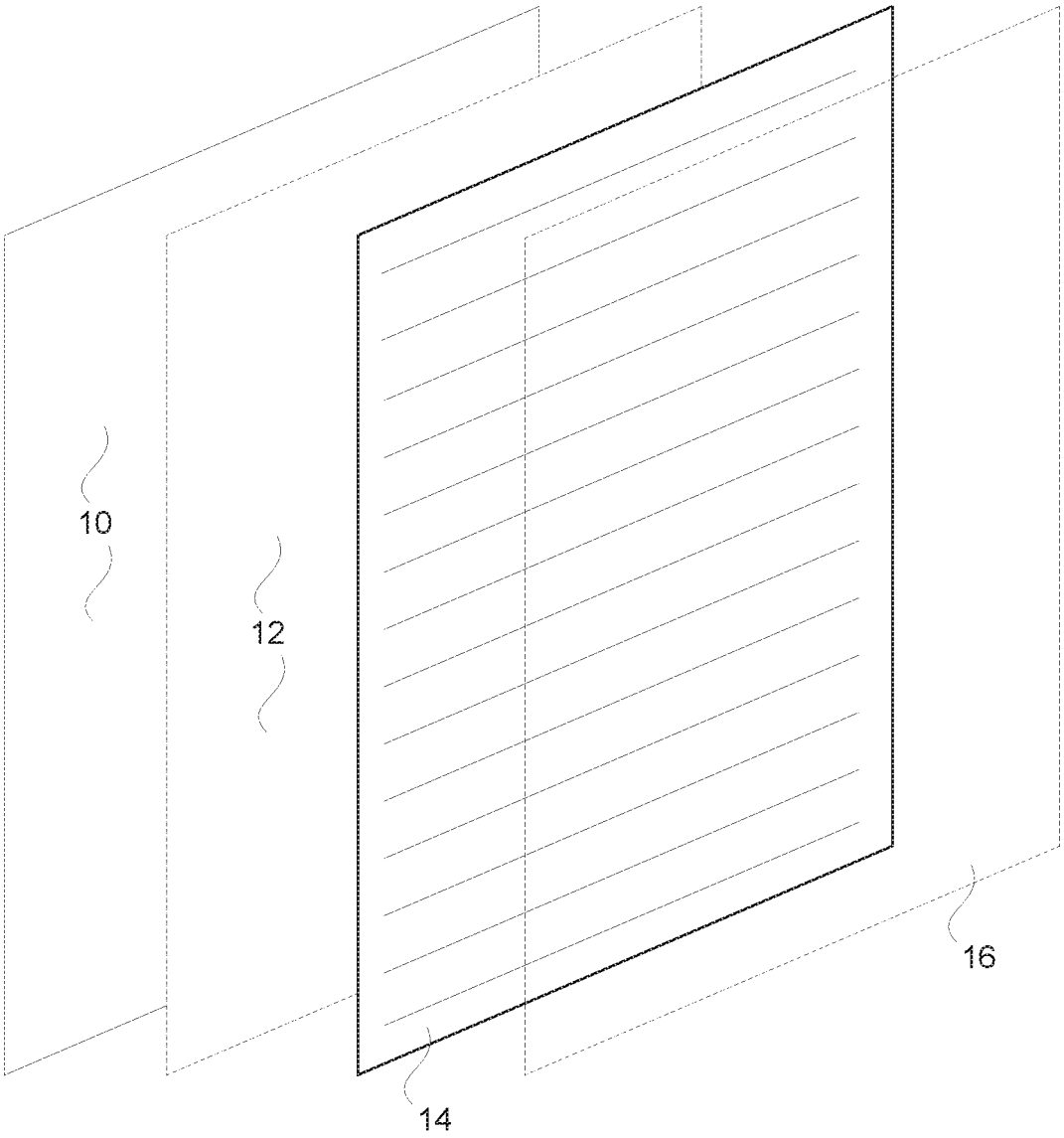
FIG. 3 is an exploded perspective view of the magnetic holding system including three layers according to FIG. 1 and illustrating magnetic polarity line spacing of the second layer.
Figure 4:
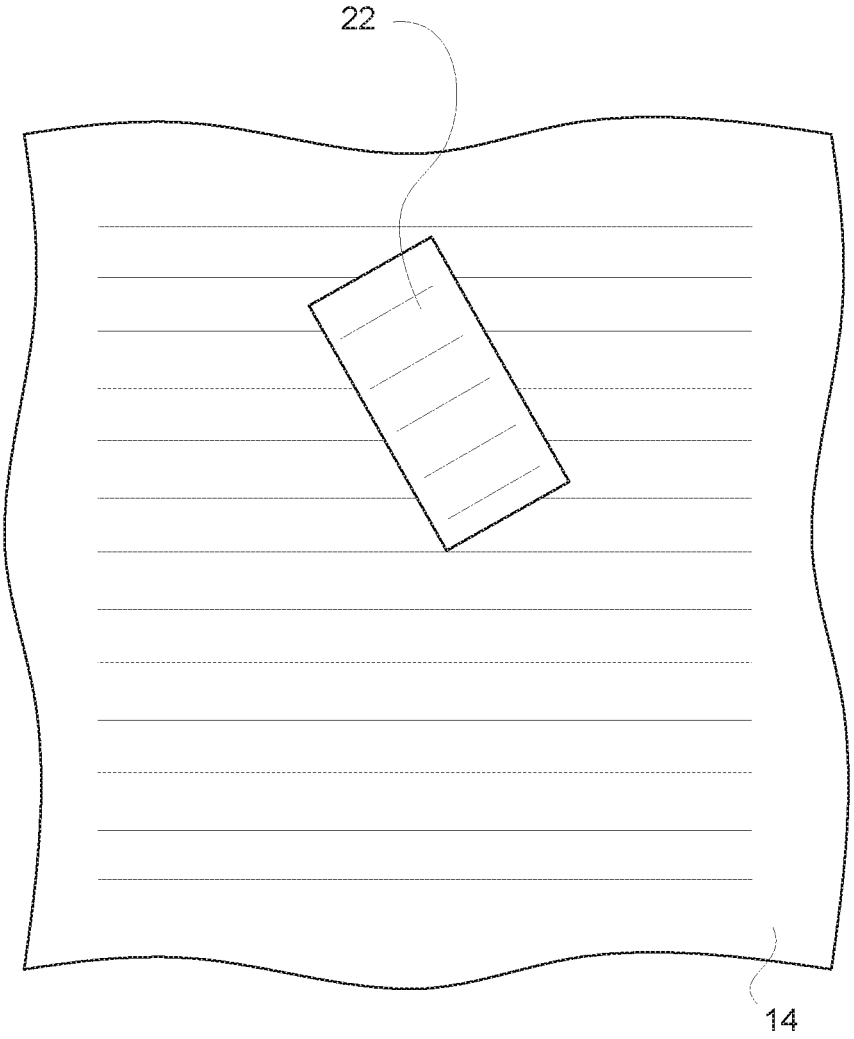
FIG. 4 is a front view of the magnetic holding system according to FIG. 1 affixed to a wall and illustrating the connecting of the object to the surface of the third layer.
Figure 5:
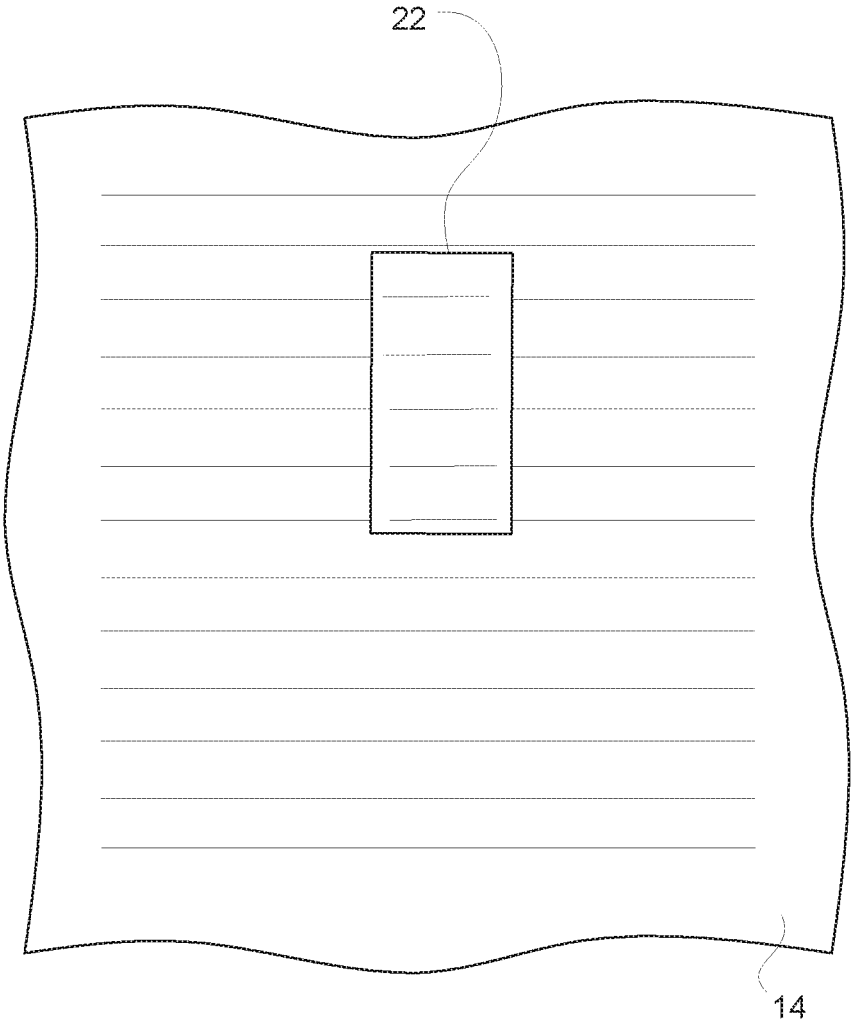
FIG. 5 is a front view of the magnetic holding system according to FIG. 1 affixed to a wall and illustrating the object affixed to the surface of the third layer.
Figure 6:
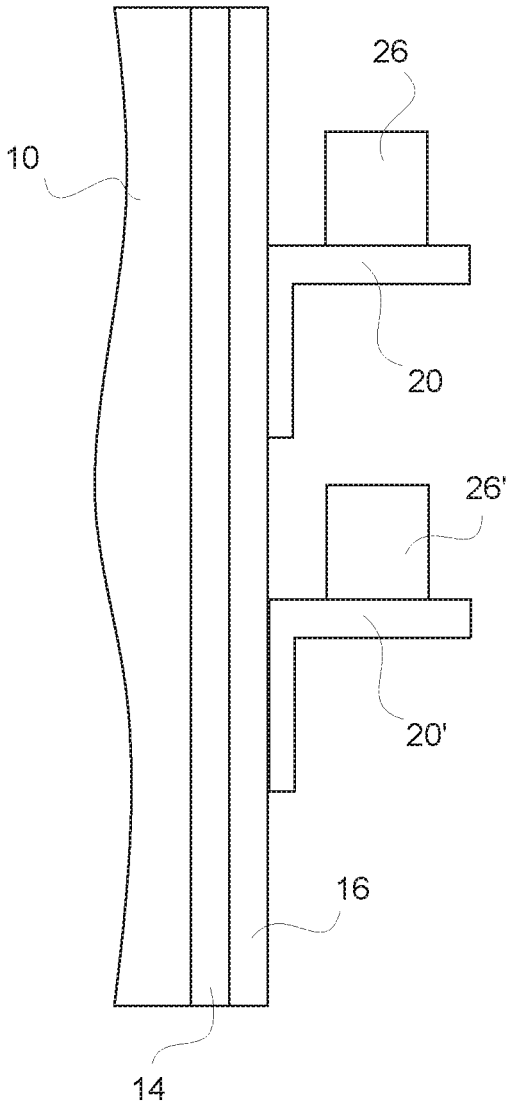
FIG. 6 is a side view of the magnetic holding system according to FIG. 2 including multiple objects affixed to the surface of the third layer.

Turning now to FIGS. 3-5, the specific polarity line spacing of the second layer 14 are illustrated. While solid lines are shown in FIG. 3, it will be understood that each line may represent a plurality of magnetic forces that are aligned generally with the specific polarity line spacing indicated. In one configuration, the plurality of magnetic lines can be provided as alternating between North and South polarities. In other words, the polarity lines in the magnetic material could be provided having alternating polarities. While generally the polarity of the lines are indicated in the drawings, one of skill in the art will understand that numerous polarity arraignments can effectively be used and the drawings are not intended to exhaust all the arraignments nor are they intended to be limiting.

Referring to FIGS. 4 and 5, magnetic forces between the mounting surface 22 of the object 20 and the first layer 12, pull the object 20 tightly to the wall surface 10. It was discovered that when the polarity line spacing of the mounting surface 22 with the magnetically permeable material and that of the first magnetic sheet layer 14 are the essentially the same (e.g., aligned), a synergistic, enhanced, magnetic pulling force is created. The pulling force is greater than the sum of the pulling force of the first magnetic sheet 14 and the pulling force of the magnetic material applied to the mounting surface 22 due to the application of the sheet of magnetically permeable material (e.g., the steel). This enhanced holding effect is also achieved when the object 20 is provided comprising steel. In one configuration the polarity line spacing is selected to be between 2 and 20 lines per inch. Preferably the polarity line spacing is selected to be in the range from 10 to 15 lines per inch.

Referring to FIG. 4, it can be seen that the mounting surface 22 is placed at an angle relative to the magnetic structure attached to the wall surface 10 including the first layer 14. In this configuration, the object 20 will be attracted to the wall due to the interaction of the mounting surface 22 with the first layer 14. However, as the magnetic polarity line spacings are not fully aligned (the mounting surface 22 is diagonal to the first layer 14), the holding power will only be moderate. When, however, the object is rotated to a vertical position as shown in FIG. 5, all the polarity line spacing fully matches up, which functions to dramatically increase the holding power such that the object 20 is firmly held against the wall surface 10. This is understood to be due to the fact that in permanent magnets, magnetic forces are the strongest at the poles such that aligning the maximum number of magnetic poles between the mounting surface 22 and the first layer 14 functions to impart the maximum holding power for the object 20 and is enhanced by the magnetically permeable material provided as a sheet of steel or providing the object itself completely made of steel.

In one configuration, the Gauss reading at 0.25" gap or greater is less than 1.0 and at 7 ft the Gauss level is not recordable. As stated, this is due to the multipole nature of ferrite materials.

Additionally, it was observed that the holding force developed between the first layer and the object when no magnetically permeable material is used, achieves a holding strength of up to 4 lb/sq ft, whereas when the sheet of magnetically permeable material is used, a holding strength of up to 10 lbs/sq ft is achieved.

Rotating the object 20 from the vertical position shown in FIG. 5 to the diagonal position shown in FIG. 4 will allow the object to be more easily removed from the wall surface 10 as the rotation effectively breaks some of the stronger magnetic bonds due to the alignment of the polarity spacings.

It is contemplated that the object 20 may comprise any dimension or shape, and preferably, is provided to hold an article 26. For instance, the object 20 can be provided as an L-shape, with one side of the L-shape being a mounting surface 22 (steel) for vertically attaching to the wall by magnetic forces, and with the other side of the L-shape being a horizontal platform for holding and displaying an article 26. As disclosed previously, by using the two matching magnetic layers (i.e., the L-shape steel surface and the second layer of magnet sheet), the overall holding strength of the platform is greatly enhanced. As such, the magnetic system provides a sturdy means to display articles on the wall "shelves" (i.e. the objects). While elongates shelves are depicted, virtually any shape or size of shelf may be used.

Figure 7:
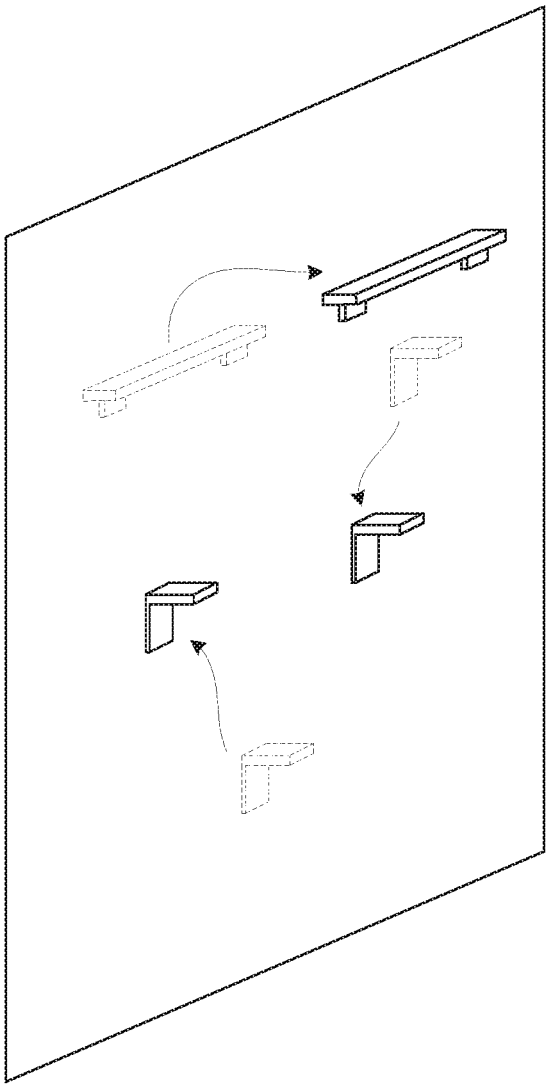
FIG. 7 is a perspective view of the magnetic holding system according to FIG. 6 including multiple objects affixed to the surface of the third layer.

One advantage of configuration is that no holes need to be drilled into the wall in order to install the wall "shelves" (i.e. the objects). Another advantage of the invention is that the wall "shelves" (i.e. the objects) can be easily placed at or relocated to different positions on the wall as illustrated in FIG. 7. More than one "shelf" can be placed on the wall at the same time. Together with a background "wall paper", the magnetic system provides a dynamic and creative display of articles in a commercial or retail setting. For example, a wall background can be a mountain climbing image (provided by an image of the third layer). The L-shaped object can be provided with a shoe shaped magnet for holding the object onto the wall, and the platform of the L-shaped object can display a pair of mountain climbing shoes.

Alternatively, instead of shoes as in the example, the magnetic system could be used to display plants or other items for sales or decoration. Moreover, the L-shaped object may have hinges for folding any sections of the object when not in use.

While the magnetic system is contemplated for commercial application, it is contemplated that the system could be used in a residential environment or in an office environment. For example, in a residential environment, the decorative image 18 on the second layer 16 may comprise a variety of wall paper that would be used in a residence. The objects 20 may comprise various shelves for that a person could position on the wall surface to hold any items they wish, including, for example, a TV. As was previously discussed, because the first layer 14 is provided as a ferrite-based magnetic system, the multipole nature of ferrite magnets does not emit a strong magnetic field into the surrounding environment, which functions to allow the use of electronics in the vicinity of the magnetic system.

Additionally, for office space environments, the decorative image 18 on the second layer 16 may also comprise a variety of wall paper that would be used in an office space. Additionally, a variety of shelves and configurations will be apparent to those of skill in the art, even for the application of holding electronic equipment.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A magnetic holding system on a wall comprising a first layer of magnetic sheet with a specific polarity line spacing, said first layer overlaid onto a wall surface;

a second layer of material having magnetic receptive properties, said second layer overlaid on the first layer; and an object having a substantially smooth mounting surface, the mounting surface comprising a magnetic material having specific polarity line spacing that is substantially the same as the specific polarity line spacing of said first layer and a magnetically permeable material so that said object comprises the magnetically permeable material in addition to the magnetic material;

wherein when the polarity line spacing of the magnetic material applied to the mounting surface is aligned with the polarity line spacing of said first layer, said object is securely held against the wall.

2. The magnetic holding system of claim 1 wherein said magnetically permeable material comprises steel.

3. The magnetic holding system of claim 1 wherein said object comprises steel.

4. The magnetic holding system of claim 1 wherein the object comprises a shelf.

5. The magnetic holding system of claim 1 wherein said object comprises an L bracket such that a flat portion of the L shaped bracket extends outwards from the wall in a horizontal direction.

6. The magnetic holding system of claim 1 wherein said object comprises at least two objects, each object may be freely removed from the wall surface and reattached to the wall surface at substantially any location along the wall surface.

7. The magnetic holding system of claim 1 wherein the polarity line spacing for the first layer and the magnetic material applied to the mounting surface is selected to be between 2 and 20 lines per inch.

8. The magnetic holding system of claim 1 wherein the holding force between the said layer and the magnetic material of the mounting surface comprises at least 10 lbs/SF.

9. The magnetic holding system of claim 1 further comprising a third layer of magnetic receptive coating applied to the wall surface, wherein said first layer comprises a double sided magnet and adheres to said wall by magnetic interaction with said third layer.

10. The magnetic holding system of claim 1 wherein said first layer comprises an adhesive backing that is applied to the wall such that said first layer adheres to said wall.

11. A magnetic holding system on a wall comprising a first layer of magnetic sheet with a specific polarity line spacing, said first layer overlaid onto a wall surface;

a second layer of material having magnetic receptive properties, said second layer overlaid on the first layer; and an object having a substantially smooth mounting surface, the mounting surface comprising a magnetic material having specific polarity line spacing that is substantially the same as the specific polarity line spacing of said first layer and a magnetically permeable material;

wherein when the polarity line spacing of the magnetic material applied to the mounting surface is aligned with the polarity line spacing of said first layer, said object is securely held against the wall;

wherein the magnetic material on the mounting surface comprises a sheet of removable double-sided magnetic material that is overlain onto the mounting surface that includes the magnetically permeable material.

12. A method for holding an object to a wall comprising the steps of:

overlaying a first layer of magnetic sheet with a specific polarity line spacing onto a wall surface;

overlaying a second layer of material having magnetic receptive properties onto the first layer;

providing an object with a substantially smooth mounting surface and comprising a magnetic material that has a polarity line spacing and a magnetically permeable material;

positioning the mounting surface against the second layer; and orienting the object such that the polarity line spacing of the magnetically permeable material of the mounting surface aligns with the polarity line spacing of the first layer such that, when the polarity line spacings are aligned, the object is securely held against the wall.

13. The method according to claim 12 wherein the magnetically permeable material comprises steel or the object comprises steel.

14. The method according to claim 12 wherein the polarity line spacing for the first layer and the magnetically permeable of the mounting surface is selected to be between 2 and 20 lines per inch.

15. The method according to claim 12 wherein a holding force between the said layer and the magnetic material of the mounting surface comprises at least 10 lbs/SF.

16. The method according to claim 12 further comprising the step of applying a third layer of magnetic receptive coating to a surface of the wall, wherein the first layer comprises a double sided magnet and adheres to the wall by magnetic interaction with said third layer.

17. The method according to claim 12 further comprising the step of providing the first layer with an adhesive backing such that the first layer may be adhered to the wall with the adhesive backing.

18. The method according to claim 12 wherein the magnetic material on the mounting surface comprises a sheet of removable double-sided magnetic material that is overlain onto the mounting surface that includes the magnetically permeable material.

* * * * *